US011623833B2

(12) United States Patent
Maeda

(10) Patent No.: US 11,623,833 B2
(45) Date of Patent: Apr. 11, 2023

(54) CONVEYANCE DEVICE AND IMAGE FORMING APPARATUS

(71) Applicant: KYOCERA Document Solutions Inc., Osaka (JP)

(72) Inventor: Ryota Maeda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 42 days.

(21) Appl. No.: 17/455,643

(22) Filed: Nov. 18, 2021

(65) Prior Publication Data

US 2022/0162026 A1 May 26, 2022

(30) Foreign Application Priority Data

Nov. 24, 2020 (JP) ..... JP2020-194400

(51) Int. Cl.

| | |
|---|---|
| ***B65H 7/20*** | (2006.01) |
| ***B65H 7/08*** | (2006.01) |
| ***G03G 15/00*** | (2006.01) |
| *B65H 9/00* | (2006.01) |
| *B65H 5/06* | (2006.01) |

(52) U.S. Cl.

CPC ..... *B65H 7/20* (2013.01); *B65H 7/08* (2013.01); *G03G 15/6558* (2013.01); *B65H 5/062* (2013.01); *B65H 9/002* (2013.01); *B65H 2301/331* (2013.01)

(58) Field of Classification Search

CPC ..... B65H 7/08

See application file for complete search history.

(56) References Cited

U.S. PATENT DOCUMENTS

| | | | | |
|---|---|---|---|---|
| 5,452,062 | A * | 9/1995 | Baldwin | G03G 15/6564 399/382 |
| 2007/0257423 | A1* | 11/2007 | Mandel | B65H 7/02 271/227 |
| 2011/0200341 | A1* | 8/2011 | Moriya | B65H 7/08 271/228 |
| 2012/0133093 | A1* | 5/2012 | Saito | B65H 7/08 271/227 |

FOREIGN PATENT DOCUMENTS

JP 2001-013823 A 1/2001

* cited by examiner

*Primary Examiner* — Jennifer Bahls

(74) *Attorney, Agent, or Firm* — Studebaker & Brackett PC

(57) ABSTRACT

A conveyance device includes a conveyance roller, a registration roller, a sensor, a mode setting part, a storage, a conveyance state determination part and a drive control part. The mode setting part sets the mode to either a plain paper mode or a tab paper mode. The storage stores threshold information corresponding to the mode. The conveyance state determination part determines, when the plain paper mode is set, whether the conveyance state of the recording medium is a skew conveyance state or a tab paper conveyance state, based on the detection result of the sensor and the plain paper mode threshold information. The conveyance state determination part determines, when the tab paper mode is set, whether the conveyance state of the recording medium is the skew conveyance state or the tab paper conveyance state, based on the detection result of the sensor and the tab paper mode threshold information.

8 Claims, 13 Drawing Sheets

170

| | FIRST THRESHOLD INFORMATION | SECOND THRESHOLD INFORMATION |
|---|---|---|
| PLAIN PAPER MODE | a1 | b1(a1<b1) |
| TAB PAPER MODE | a2 | b2(a2<b2<b1) |

170

| | FIRST THRESHOLD INFORMATION | SECOND THRESHOLD INFORMATION | THIRD THRESHOLD INFORMATION |
|---|---|---|---|
| PLAIN PAPER MODE | a1 | b1(a1<b1) | c1(b1<c1) |
| TAB PAPER MODE | a2 | b2(a2<b2<b1) | c2(b2<c2) |

170

| | FIRST THRESHOLD INFORMATION | SECOND THRESHOLD INFORMATION |
|---|---|---|
| PLAIN PAPER MODE | a1 | b1(a1<b1) |
| TAB PAPER MODE | a2 | b2(a2<b2<b1) |
| CARDBOARD MODE | a3 | b3(a3<b2<b3<b1) |

CONVEYANCE DEVICE AND IMAGE FORMING APPARATUS

INCORPORATION BY REFERENCE

This application is based on and claims the benefit of priority from Japanese patent application No. 2020-194400 filed on Nov. 24, 2020, which is incorporated by reference in its entirety.

BACKGROUND

The present disclosure relates to a conveyance device and an image forming apparatus.

An image forming apparatus configured to form an image on a recording medium such as a paper sheet is used for various purpose. In some cases, the image forming apparatus can form an image on not only on a rectangular sheet but also on a tab sheet that a tab is protruded from a part of an end face of a sheet. For example, an image forming apparatus which detects a position of the tab of the sheet being conveyed, and forms an image on the tab at the predetermined position has been discussed.

Conventionally, in order to form an image on a sheet adequately, when the sheet is conveyed with a skew posture, the image forming apparatus is configured to correct the skew of the sheet. Typically, the skew of the sheet is corrected by stopping the sheet being conveyed using a registration roller.

However, in a case where the tab sheet is conveyed as the above-described image forming apparatus, when the sheet is conveyed in a skew posture, the sheet is stopped by the registration roller in order to correct the skew. Then, the tab of the sheet comes into contact with the registration roller, and may be deformed. Therefore, it is required to determine a conveyance state of the sheet with high accuracy.

SUMMARY

In accordance with an aspect of the present disclosure, a conveyance device includes a conveyance roller, a registration roller, a sensor, a mode setting part, a storage, a conveyance state determination part and a drive control part. The conveyance roller conveys a recording medium. The registration roller stops a conveying of the recording medium conveyed by the conveyance roller and then starts the conveying of the recording medium again. The sensor detects the recording medium conveyed by the conveyance roller. The mode setting part sets a mode corresponding to a type of the recording medium. The storage stores threshold information corresponding to the mode set in the mode setting part. The conveyance state determination part determines a conveyance state of the recording medium based on a detection result of the sensor and the threshold information. The drive control part controls a driving of the conveyance roller and the registration roller based on a determination result of the conveyance state determination part. The mode setting part sets the mode to either a plain paper mode or a tab paper mode. The storage stores plain paper mode threshold information showing a threshold used in the plain paper mode and tab paper mode threshold information showing a threshold used in the tab paper mode. The conveyance state determination part determines, when the plain paper mode is set, whether the conveyance state of the recording medium is a skew conveyance state or a tab paper conveyance state, based on the detection result of the sensor and the plain paper mode threshold information. The conveyance state determination part determines, when the tab paper mode is set, whether the conveyance state of the recording medium is the skew conveyance state or the tab paper conveyance state, based on the detection result of the sensor and the tab paper mode threshold information.

In accordance with an aspect of the present disclosure, an image forming apparatus includes the conveyance device and an image forming part which forms an image on the recording medium conveyed by the conveyance device.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
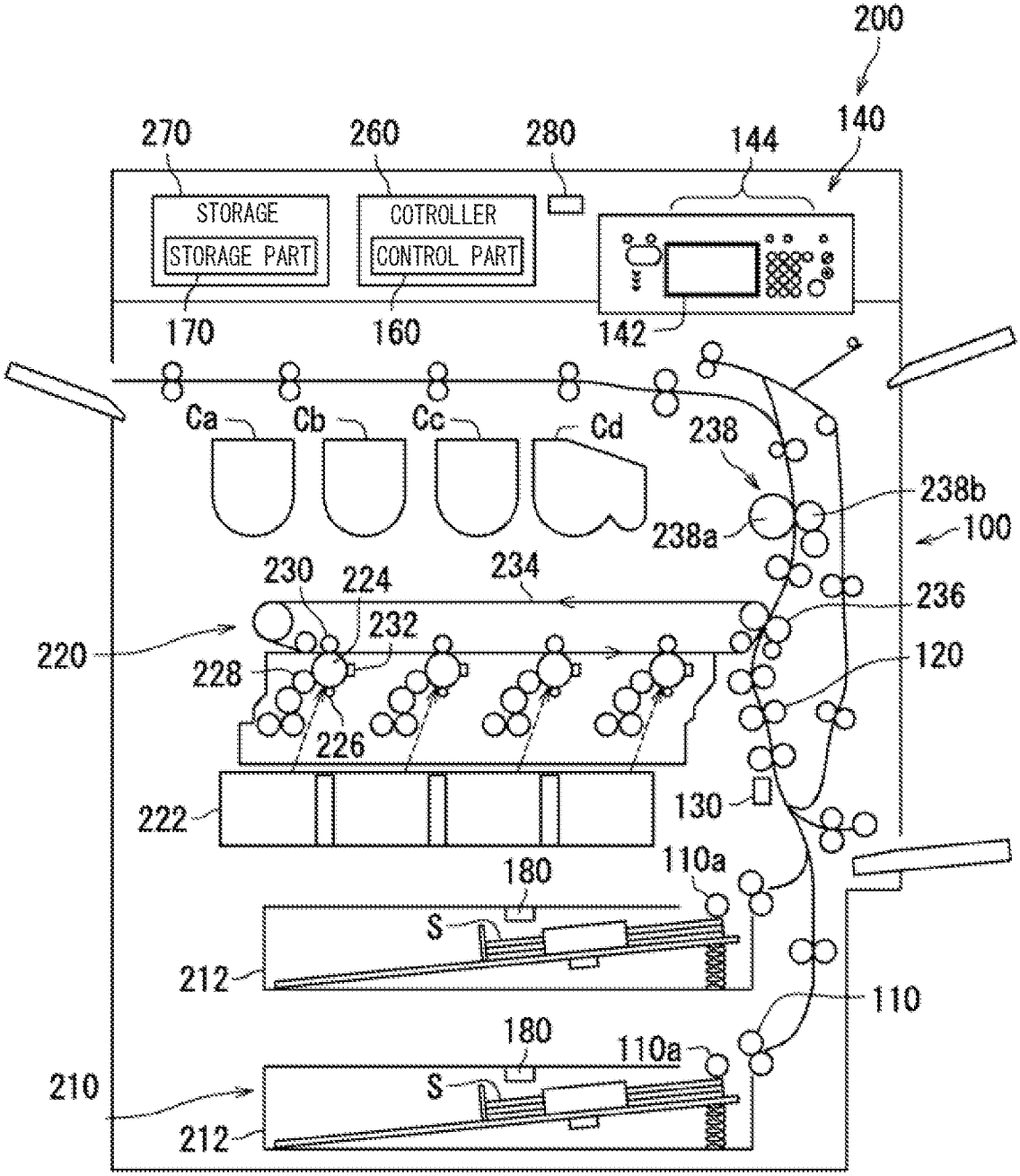
FIG. 1 is a schematic view showing an image forming apparatus according to the embodiment.

Hereinafter, with reference to the attached drawings, one embodiment of a conveyance device and an image forming apparatus according to the present disclosure will be described. In the drawings, the same or corresponding parts are designated by the same reference numerals, and description thereof is not repeated.

First, with reference to FIG. 1, a configuration of an image forming apparatus 200 provided with a conveyance device 100 of the embodiment will be described. FIG. 1 is a schematic view showing the image forming apparatus 200. The image forming apparatus 200 forms an image on a sheet S. The image forming apparatus 200 is, for example, a printer, a copying machine, or a multifunctional peripheral. The image forming apparatus 200 may have a facsimile function. Here, the image forming apparatus 200 is an electrophotographic type.

The image forming apparatus 200 is provided with the conveyance device 100. The conveyance device 100 conveys the sheet S. The conveyance device 100 is installed in a housing of the image forming apparatus 200.

The sheet S includes a plain paper and a tab paper. Typically, the thickness of the plain paper is not less than 0.07 mm and not more than 0.13 mm. The tab paper has a tab protruding from a part of an end face of a rectangular paper. The number of tabs may be plural. Also, although it is not limited thereto, the thickness of the tab paper is typically the same as the thickness of the plain paper. Further, the sheet S may include a cardboard. Typically, the thickness of the cardboard is not less than 0.15 mm and not more than 1.2 mm. The sheet S is an example of a recording medium.

The conveyance device 100 includes a conveyance roller 110, a registration roller 120, a sensor 130, an input/output part 140, a control part 160, and a storage part 170. The conveyance roller 110 conveys the sheet S. Typically, the conveyance device 100 includes a plurality of the conveyance rollers 110. In the conveyance device 100, a conveyance path for the sheet S is formed by the plurality of conveyance rollers 110.

The conveyance roller 110 includes a pair of rollers rotatable around a rotational shaft. The rollers face each other and rotate around the rotational shaft. In an example, one roller of the pair of rollers rotates by a power of a motor, and the other roller rotates following the one roller. The sheet S enters between the rotating rollers, is biased by the rollers and then is pushed out of the rollers.

Here, the conveyance roller 110 includes a sheet feeding roller 110*a*. The sheet feeding roller 110*a* is used to pick up the placed sheet S. Here, the sheet feeding roller 110*a* is included in the conveyance roller 110. Therefore, the conveyance roller 110 conveys the sheet S from the placement position to the end point. However, the sheet feeding roller 110*a* may not be included in the conveyance roller 110. That is, the conveyance roller 110 may continue conveying the sheet S for which the conveying has started.

The registration roller 120 deflects the sheet S. Specifically, the registration roller 120 stops the conveying of the sheet S along the conveyance path once. Therefore, the sheet S is deflected by the registration roller 120, and the registration roller 120 corrects the skew of the sheet with respect to the conveyance direction of the sheet S. The registration roller 120 does not rotate when the leading edge of the sheet S reaches, and starts the rotating after the leading edge of the sheet S reaches. Thus, the skew of the sheet S can be corrected. The registration roller 120 may have the same configuration as that of the conveyance roller 110.

In the above manner, the registration roller 120 stops the conveying of the sheet S conveyed by the conveyance roller 110 once, and then starts the conveying of the sheet S. A timing of the conveying of the sheet S can be adjusted by the registration roller 120. Because the registration roller 120 stops the conveying of the sheet S, even if the sheet S is conveyed with a skew posture by the conveyance roller 110 until it reaches the registration roller 120, the skew of the sheet S can be corrected.

In the conveyance device 100 of the present embodiment, the conveyance roller 110 may preferably correct the skew of the sheet S without stopping the sheet S by the registration roller 120. For example, by changing a rotational speed or a posture of the conveyance roller 110, the skew of the sheet S can be corrected. As an example, in a case where the conveyance roller 110 disposed at one place on the conveyance path includes a plurality of rollers arranged in a row along a direction perpendicular to the conveyance direction of the sheet S, the rotational speed or the posture of the roller on one side of the row is controlled to be different from the rotational speed or the posture of the roller on the other side of the row, so that the skew of the sheet S can be corrected.

The skew of the sheet S is corrected based on a detection result of the sensor 130. Typically, after the skew of the sheet S is determined based on the detection result of the sensor 130, by changing the rotational speed or the posture of the conveyance roller 110 disposed on the downstream side of the sensor 130, the skew of the sheet S can be corrected.

The sensor 130 detects the sheet conveyed by the conveyance roller 110. The sensor 130 detects the sheet passing the conveyance path along which the sheet is conveyed by the conveyance roller 110. The sensor 130 detects timing at which different positions on the end face of the sheet S pass. Based on the detection result of the sensor 130, the skew of the sheet S can be detected.

The sensor 130 is disposed on the upstream side of the registration roller 120 on the conveyance path. Then, registration roller 120 can control whether the skew of the sheet S is corrected based on the detection result of the sensor 130.

The input/output part 140 includes a display part 142 and an input part 144. The display part 142 displays an operation screen or result of various processing. The display part 142 includes a liquid crystal display or an organic EL display.

The input part 144 includes various keys for instructing a type or a content of a job, for example. The input part 144 includes a button or a keyboard. Alternatively, the input part 144 may include a touch sensor. The display part 14 and the input part 144 may be integrated in one touch panel.

The control part 160 controls the operation of the conveyance device 100. The control part 160 controls the conveyance roller 110, the registration roller 120, the sensor 130 and the input/output part 140.

The control part 160 includes an arithmetic element. The arithmetic element includes a processer. As an example, the processer includes a central processing unit (CPU). The processer may include an application specific integrated circuit (ASIC).

The storage part 170 stores various data. For example, the storage part 170 stores a control program. The control part 160 controls the conveyance roller 110, the registration roller 120, the sensor 130 and the input/output part 140 using information stored in the storage part 170.

The control part 160 executes the control program to control the operation of the conveyance device 100. In detail, the processer of the control part 160 executes the computer program stored in the storage element of the storage part 170 to control each part of the conveyance device 100.

For example, the computer program is stored in a non-temporal computer readable storage medium. The non-temporal computer readable storage medium includes a ROM (Read Only Memory), a RAM (Random Access Memory), a CD-ROM, a magnetic tape, a magnetic disk or an optical data storage device.

The image forming apparatus 200 is provided with a sheet storage part 210, an image forming part 220, a controller 260 and a storage 270 in addition to the conveyance device 100.

The sheet storage part 210 stores the sheet S. The sheet storage part 210 stores a plain paper or a tab paper as the sheet S. The sheet storage part 210 may store a cardboard as the sheet S.

The sheet storage part 210 includes a cassette 212. A plurality of the sheets S is stored in the cassette 212.

The sheet feeding roller 110*a* is disposed in the sheet storage part 210. The sheet feeding roller 110*a* feeds the sheet S stored in the cassette 212. The sheet feeding roller 110*a* starts the conveying of the sheet S placed on the sheet storage part 210. The sheet feeding roller 110*a* feeds the sheet S one by one as required. The sheet feeding roller 110*a* feeds the uppermost sheet S of the plurality of sheets S stored in the cassette 212. Here, the sheet storage part 210 included a plurality of the cassettes 212, and the sheet feeding roller 110*a* is provided for each cassette 212.

The conveyance device 100 conveys the sheet S to the image forming part 220. In detail, the conveyance device 100 conveys the sheet S placed on the sheet storage part 210 to the image forming part 220 one by one. After the image forming part 220 forms an image on the sheet S, the conveyance device 100 conveys the sheet S from the image forming part 220 to an outside of the image forming apparatus 200.

In the image forming apparatus 200, the registration roller 120 is disposed on an upstream side of the image forming part 220. The registration roller 120 corrects the skew of the sheet S. The registration roller 120 stops the conveying of the sheet S once to correct the skew of the sheet S, and then conveys the sheet S to the image forming part 220.

The registration roller 120 can adjust timing for conveying the sheet S to the image forming part 20. The registration roller 120 stops the conveying of the sheet S once, and then conveys the sheet to the image forming part 220 with predetermined timing of the image forming part 220.

Toner containers Ca to Cd are attached to the image forming apparatus 200. Each of the toner containers Ca to Cd are detachably attached to the image forming apparatus 200. The toner containers Ca to Cd store toners of different colors. The toners in the toner containers Ca to Cd are supplied to the image forming part 220. The image forming part 220 forms the images using the toner supplied from the toner containers Ca to Cd.

For example, the toner container Ca stores the yellow toner, and supplies the yellow toner to the image forming part 220. The toner container Cb stores the magenta toner, and supplies the magenta toner to the image forming part 220. The toner container Cc stores the cyan toner, and supplies the cyan toner to the image forming part 220. The toner container Cd stores the black toner, and supplies the black toner to the image forming part 220.

The image forming part 220 forms the images on the sheet S based on image data using the toners stored in the toner containers Ca to Cd. Here, the image forming part 220 includes an exposure part 222, photosensitive drums 224, charging parts 226, development parts 228, primary transfer rollers 230, cleaning parts 232, an intermediate transfer belt 234, a secondary transfer roller 236 and a fixing part 238.

The intermediate transfer belt 234 circulates by a roller rotating with a drive force of a motor. The development part 228 is provided with a motor. The toner in the development part 228 is agitated with the rotating of the motor.

The photosensitive drum 224, the charging part 226, the primary transfer roller 230 and the cleaning part 232 are provided for each of the toner containers Ca to Cd. The photosensitive drums 224 come into contact with the outer circumferential surface of the intermediate transfer belt 234, and are disposed along the circulation direction of the intermediate transfer belt 234. The primary transfer rollers 230 are provided corresponding to the photosensitive drums 224. The primary transfer rollers 230 face the photosensitive drums 224 through the intermediate transfer belt 234.

The charging part 226 charges the circumferential surface of the photosensitive drum 224. The exposure part 222 emits light based on the image data on each photosensitive drums 224, and an electrostatic latent image is formed on the circumferential surface of the photosensitive drum 224. The development part 228 develops the electrostatic latent image with the toner, and forms the toner image on the photosensitive drum 224. Therefore, the photosensitive drum 224 carries the toner image. The primary transfer roller 230 transfers the toner image on the photosensitive drum 224 to the outer circumferential surface of the intermediate transfer belt 234. The cleaning part 232 removes the toner remaining on the circumferential surface of the photosensitive drum 224.

The photosensitive drum 224 corresponding to the toner container Ca forms the yellow toner image based on the electrostatic latent image, the photosensitive drum 224 corresponding to the toner container Cb forms the magenta toner image based on the electrostatic latent image, the photosensitive drum 224 corresponding to the toner container Cc forms the cyan toner image based on the electrostatic latent image, and the photosensitive drum 224 corresponding to the toner container Cd forms the black toner image based on the electrostatic latent image.

On the outer circumferential surface of the intermediate transfer belt 234, the toner images of the colors are overlapped and transferred from the photosensitive drums 223, and forms the image. Therefore, the intermediate transfer belt 234 carries the image. The secondary transfer roller 236 transfers the image on the outer circumferential surface of the intermediate transfer belt 234 to the sheet S.

The fixing part 238 heats and presses the sheet S on which the toner image is transferred to fix the toner image on the sheet S. The fixing part 238 includes a heating roller 238*a* and a pressing roller 238*b*. The heating roller 238*a* and the pressing roller 238*b* disposed facing each other, and form a fixing nip. The sheet S passed between the intermediate transfer belt 234 and the secondary transfer roller 236 is passed through the fixing nip to be heated at a predetermined temperature and pressed. As a result, the toner image is fixed on the sheet S. The conveyance device 100 discharges the sheet S on which the toner image is fixed to the outside of the image forming apparatus 200.

The controller 260 controls the operation of the image forming part 220. The controller 260 includes an arithmetic element. The arithmetic element includes a processer. As an example, the processer includes a central processing unit (CPU). The processer may include an application specific integrated circuit (ASIC).

The storage 270 stores various data. The controller 260 controls the image forming part 220 using information stored in the storage 270.

For example, the storage 270 stores a control program. The controller 260 executes the control program to control the operation of the image forming apparatus 200. In detail, the processer of the controller 260 executes the computer program stored in the storage element of the storage 270 to control each part of the image forming apparatus 200.

For example, the computer program is stored in a non-temporal computer readable storage medium. The non-temporal computer readable storage medium includes a ROM (Read Only Memory), a RAM (Random Access Memory), a CD-ROM, a magnetic tape, a magnetic disk or an optical data storage device.

The conveyance device 100 may include a media sensor 180. The media sensor 180 may detect a type of the sheet S. For example, the media sensor 180 is disposed in the sheet storage part 210. The media sensor 180 detects a type of the sheet S stored in the cassette 212. The media sensor 180 may be disposed on the conveyance path for the sheet S, and detect a type of the sheet S being conveyed.

The image forming apparatus 200 may be provided with a communication part 280. The communication part 280 is communicated with an external electric device provided with a communication device which uses the same communication system (a protocol). The communication part 280 is communicated with the external electric device via a network such as a WAN (Wide Area Network) or a LAN (Local Area Network). The communication part 280 may be communicated with the external electric device via an Internet.

Figure 2:
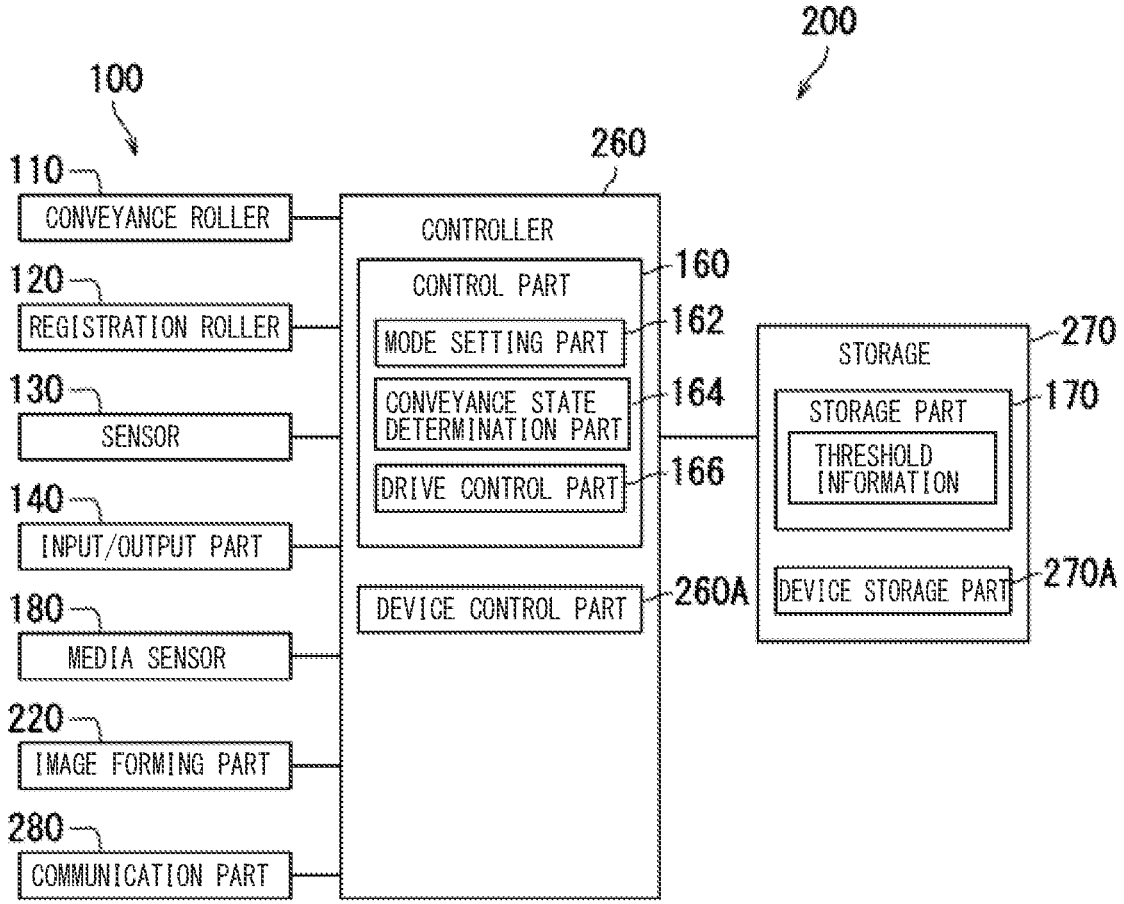
FIG. 2 is a block diagram showing the image forming apparatus according to the embodiment.

Next, with reference to FIG. 1 and FIG. 2, the conveyance device 100 and the image forming apparatus 200 of the present embodiment will be described. FIG. 2 is a block diagram showing the conveyance device 100 and the image forming apparatus 200 of the present embodiment.

As shown in FIG. 2, the controller 260 includes a control part 160 and a device control part 260A. The control part 160 controls the conveyance roller 110, the registration roller 120, the sensor 130, the input/output part 140 and the media sensor 180. The device control part 260A controls the image forming part 220 and the communication part 280. The controller 260 can control the conveyance device 110 and the image forming part 220 in an interlocking manner.

The storage 270 includes the storage part 170 and a device storage part 270A. The storage part 170 stores information used for controlling the control part 160. The device storage part 270A stores information used for controlling the device storage part 260A.

The storage part 170 stores threshold information. The threshold information is used for determining a conveyance state of the sheet S.

The control part 160 includes a mode setting part 162, a conveyance state determination part 164 and a drive control part 166. The mode setting part 162, the conveyance state determination part 164 and the drive control part 166 are embodied by executing the computer program stored in the storage part 170 by the control part 160.

The mode setting part 162 sets a paper mode corresponding to the type of the sheet to be conveyed. The type of the sheet may be different from each other depending on a shape, a thickness, a size and/or a weight of the sheet. For example, the mode setting part 162 sets the paper mode to either to a plain paper mode or a tab paper mode. The storage part 170 stores the different threshold information depending on the paper mode set by the mode setting part 162.

The mode setting part 162 may set the sheet mode by an input from the input part 144. Alternatively, the mode setting part 162 may set the sheet mode depending on the setting of the print job received by the communication part 280. Alternatively, the mode setting part 162 may set the sheet mode depending on the type of the sheet detected by the media sensor 180 installed in the conveyance device 100. For example, the media sensor 180 is installed in the sheet storage part 210 or the conveyance path. The mode setting part 162 may set the sheet mode to the plain paper mode as a default, and set the sheet mode to the mode other than the plain paper mode (for example, the tab paper mode) by specific instruction.

The conveyance state determination part 164 determines the conveyance state of the sheet S based on the detection result of the sensor 130 and the threshold information. For example, the conveyance state determination part 164 determines whether the conveyance state of the sheet S is a skew conveyance state or a tab paper conveyance state. The skew conveyance state is a state where the conveyance state determination part 164 determines that the plain paper as the sheet S is conveyed with a skew posture. The tab paper conveyance state is a state where the conveyance state determination part 164 determines that the sheet S being conveyed is a tab paper.

The detection result of the sensor 130 is used for determining the conveyance state of the sheet S. In a case where the sheet S is a rectangular plain paper, when the sheet S is normally conveyed without a skew, timing detected by the sensor 130 at which the plurality positions of the sheet S pass are substantially equal. On the other hand, when the sheet S is conveyed with a skew posture, timing detected by the sensor 130 at which the plurality positions of the sheet S pass are different from each other. Therefore, the conveyance state determination part 164 determines the conveyance state of the sheet S using the detection result of the sensors 130.

In a case where the sheet S is the tab paper, even if the sheet S is normally conveyed without a skew, timing detected by the sensor 130 at which the plurality positions of the sheet S pass are different from each other. Therefore, the conveyance state determination part 164 determines the conveyance state of the sheet S using the detection result of the sensors 130.

Depending on a time difference in which the plurality of positions on the end face of the sheet S pass through the detection regions of the sensor 130, the skew of the plain paper and the tab paper can be determined. When the plain paper is conveyed with a skew posture, the timer difference is relatively short. On the other hand, when the tab paper is conveyed, the timer difference is relatively long. Therefore, depending on a magnitude of the time difference, it can be determined whether the plain paper is conveyed with a skew posture or the tab paper is conveyed.

The drive control part 166 controls the driving of the conveyance roller 110 and the registration roller 120 based on the determination result of the conveyance state determination part 164. For example, when the conveyance state determination part 164 determines the conveyance state is the skew conveyance state, the drive control part 166 drives the registration roller 120 to stop the conveying of the sheet S once, and then to start the conveying of the sheet S again. Then, the skew of the sheet S can be corrected.

When the conveyance state determination part 164 determines that the sheet conveyance state is the tab paper conveyance state, the drive control part 166 continues the conveying of the sheet S without stopping the conveying of the sheet S by the registration roller 120. Then, it becomes possible to inhibit the tab of the sheet S from coming into contact with the registration roller 120 and to suppress the deformation of the tab of the sheet S.

Next, with reference to FIG. 1 to FIG. 3B, the setting of the sheet mode and the threshold information corresponding to the set sheet mode in the conveyance device 100 of the present embodiment will be described. FIG. 3A is a diagram schematically showing the setting the sheet mode in the conveyance device 100 of the present embodiment, and FIG. 3B is a table showing the threshold information corresponding to the sheet mode in the conveyance device 100 of the present embodiment.

Figures 3A, 3B:
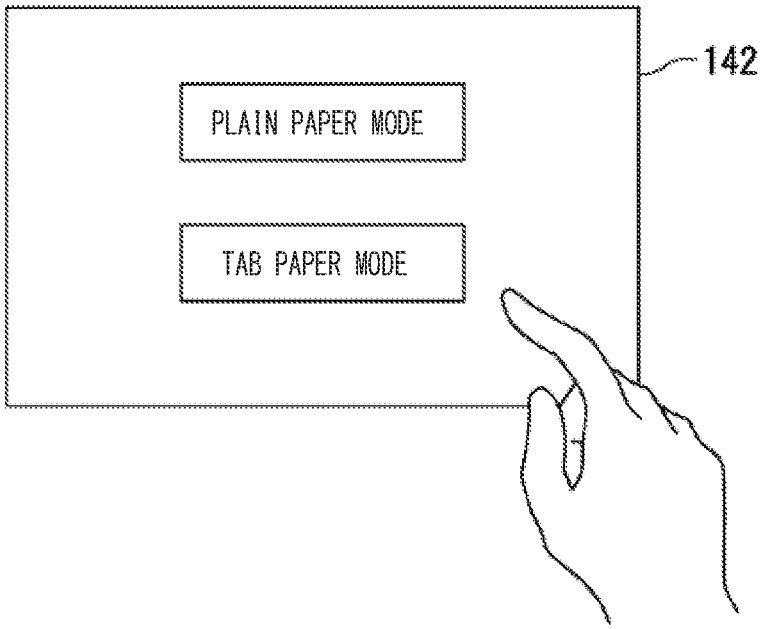
FIG. 3A is a schematic view showing a setting of a sheet mode in a conveyance device according to the embodiment.
FIG. 3B is a table showing threshold information corresponding to the sheet mode in the conveyance device according to the embodiment.

As shown in FIG. 3A, the conveyance device 100 can set the sheet mode to either the plain paper mode or the tab paper mode. For example, the sheet mode can be input via the input part 144. As shown in FIG. 3A, in a case where the display part 142 and the input part 144 are the touch panel, when an icon for the plain paper mode is touched, it is set to the plain paper mode. On the other hand, when an icon for the tab paper mode is touched, it is set to the tab paper mode.

The plain paper mode is a mode suitable for the conveying of the plain paper. However, if it is set to the plain paper mode, a sheet other than the plain paper may be conveyed. For example, when it is set to the plain paper mode, even if the tab paper is contained in the sheets S stored in the sheet storage part 210, the tab paper may be conveyed. When it is set to the plain paper mode, it is determined whether the sheet S being conveyed is the plain paper conveyed normally, the plain paper conveyed with a skew posture, or the tab paper.

The tab paper mode is a mode suitable for the conveying of the tab paper. However, if it is set to the tab paper mode, a sheet other than the tab paper may be conveyed. For example, when it is set to the tab paper mode, even if the plain paper is contained in the sheets S stored in the sheet storage part 210, the plain paper may be conveyed. When it is set to the tab paper mode, it is determined whether the sheet S being conveyed is the plain paper conveyed normally, the plain paper conveyed with a skew posture, or the tab paper.

As describe above, the determination of the conveyance state of the sheet S is performed using the threshold information stored in the storage part 170. The threshold information of the plain paper mode used in a case where it is set to the plain paper mode is not the same as the threshold information of the tab paper mode used in a case where it is set to the tab paper mode.

As shown in FIG. 3B, the storage part 170 stores first threshold information and second threshold information. The first threshold information shows a first threshold using for determining whether the plain paper is conveyed normally or with a skew posture. The second threshold information shows a second threshold using for determining whether the sheet S is the plain paper conveyed with a skew posture or the tab paper.

In the plain paper mode, the first threshold information shows a first threshold a1. The first threshold a1 is used for determining whether the sheet is conveyed normally or with a skew posture. When the time difference is less than the first threshold a1, it is determined that the sheet S is conveyed normally (is not conveyed with a skew posture).

In the plain paper mode, the second threshold information shows a second threshold b1. The second threshold b1 is larger than the first threshold a1 (a1<b1). The second threshold b1 is used for determining whether the sheet is conveyed with a skew posture or the tab paper is conveyed. When the time difference is not less than the first threshold a1 and less than the second threshold b1, it is determined that the sheet S is conveyed with a skew posture.

In the tab paper mode, the first threshold information shows a first threshold a2. The first threshold a2 is used for determining whether the plain paper is conveyed normally or with a skew posture. When the time difference is less than the first threshold a2, it is determined that the sheet S is conveyed normally (is not conveyed with a skew posture).

In the tab paper mode, the second threshold information shows a second threshold b2. The second threshold b2 is larger than the first threshold a2 (a2<b2). The second threshold b2 is used for determining whether the sheet is conveyed with a skew posture or the tab paper is conveyed. When the time difference is not less than the second threshold b2, it is determined that the sheet S is the tab paper. When the time difference is not less than the first threshold a1 and less than the second threshold b2, it is determined that the sheet S is conveyed with a skew posture.

Here, the first threshold a2 in the tab paper mode is equal to the first threshold a1 in the plain paper mode (a2=a1). Then, regardless of a shape of the sheet, a normal conveyance state and a skew conveyance state of the sheet can be determined.

The second threshold b2 in the tab paper mode is smaller than the second threshold b1 in the plain paper mode (b2<b1). Then, in the tab paper mode, it can be determined that the sheet is the tab paper over a wider range than in the plain paper mode.

Figure 4A:
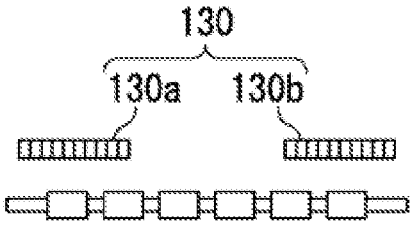
FIG. 4A is a schematic view showing an arrangement of a sheet and a sensor in the conveyance device according to the embodiment.
Figure 4B:
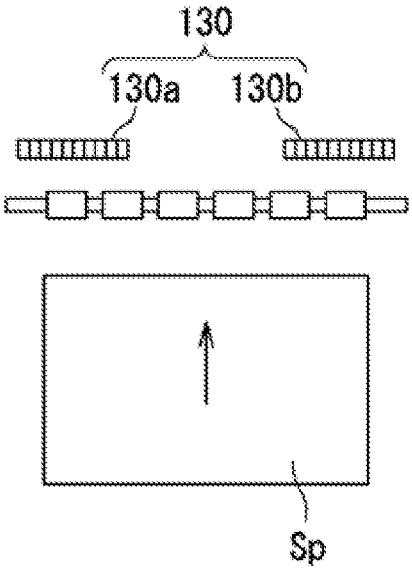
FIG. 4B is a schematic view showing a plain paper conveyed normally in the conveyance device according to the embodiment.
Figure 4C:
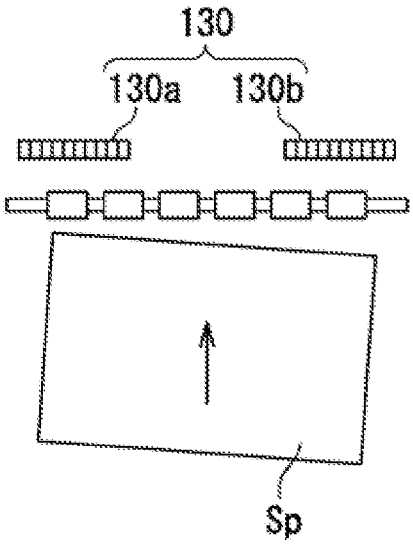
FIG. 4C is a schematic view showing a plain paper conveyed with a skew posture in the conveyance device according to the embodiment.
Figure 4D:
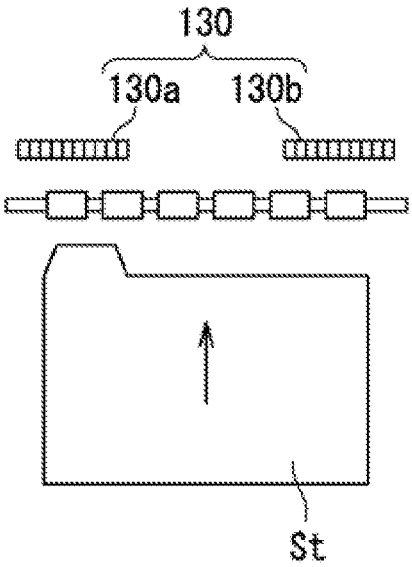
FIG. 4D is a schematic view showing a tab paper conveyed in the conveyance device according to the embodiment.

Next, with reference to FIG. 4A to FIG. 4D, the conveying of the sheet in the conveyance device 100 will be described. FIG. 4A is a diagram schematically showing the sensor 130 installed in the conveyance path in the conveyance device 100. FIG. 4B is a diagram schematically showing the plain paper conveyed normally in the conveyance device 100. FIG. 4C is a diagram schematically showing the plain paper conveyed with a skew posture in the conveyance device 100. FIG. 4D is a diagram schematically showing the tab paper conveyed normally in the conveyance device 100.

As shown in FIG. 4A, in the conveyance device 100, the sensor 130 is installed in the sheet conveyance path, and detects the sheet S conveyed along the conveyance path. The sensor 130 detects the passages of the different regions of the end face of the sheet S, and obtains a time difference in which the different regions pass.

The sensor 130 includes a first sensor 130*a* and a second sensor 130*b*. The first sensor 130*a* detects one side end portion of the sheet being conveyed, and the second sensor 130*b* detects the other side end portion of the sheet being conveyed. Here, the first sensor 130*a* and the second sensor 130*b* are disposed at positions perpendicular to the conveyance path.

The first sensor 130*a* detects the passage of the left side portion of the end face of the sheet S being conveyed by the conveyance roller 110. The second sensor 130*b* detects the passage of the right side portion of the end face of the sheet S being conveyed by the conveyance roller 110. From the detection results of the first sensor 130*a* and the second sensor 103*b*, the time difference in which the different portions of the end face of the sheet S pass through the sensor 130.

The first sensor 130*a* may have a light emitting part and a light receiving part facing each other on both sides of the conveyance path. Alternatively, the first sensor 130*a* may have a light emitting part and a light receiving part disposed on one side to the conveyance path. In the same manner, the second sensor 130*b* may have a light emitting part and a light receiving part facing each other on both sides of the conveyance path. Alternatively, the second sensor 130*b* may have a light emitting part and a light receiving part disposed on one side to the conveyance path.

As shown in FIG. 4B, when the plain paper Sp is conveyed normally, the plain paper Sp passes below the first sensor 130*a* and the second sensor 130*b* at substantially the same timing. Therefore, the first sensor 130*a* and the second sensor 13*b* detect the passage of the sheet at substantially the same timing. In this case, the difference ("time difference") between the timing when the first sensor 130*a* detects the plain paper Sp and the timing when the second sensor 130*b* detects the plain paper Sp is substantially zero.

As shown in FIG. 4C, when the plain paper Sp is conveyed with a skew posture, the timing when the first sensor 130*a* detects the passage of the sheet is different from the timing when the second sensor 130*b* detects the passage of the sheet.

For example, as shown in FIG. 4C, when the plain paper Sp is conveyed with a posture where the left side portion of the plain paper Sp is positioned on the upstream side in the conveyance direction, the first sensor 130*a* detects the plain paper Sp first, and then the second sensor 130*b* detects the plain paper Sp. Therefore, the timing when the first sensor 130*a* detects the plain paper Sp is earlier than the timing when the second sensor 130*b* detects the plain paper Sp, and a time difference is generated between the timing when the first sensor 130*a* detects the plain paper Sp and the timing when the second sensor 130*b* detects the plain paper Sp. Then, depending on a magnitude of the time difference, it becomes possible to determine whether the sheet is conveyed normally or with a skew posture.

In FIG. 4B and FIG. 4C, the sheet conveyed in the conveyance device 100 is the plain paper Sp, but the conveyance device 100 may convey the tab paper as the sheet.

As shown in FIG. 4D, when the tab paper St is conveyed, the timing when the first sensor 130*a* detects the passage of the sheet is different from the timing when the second sensor 13*b* detects the passage of the sheet. In a case where the tab paper St is conveyed in such a manner that the tab is positioned on the left upstream side of the tab paper St, the first sensor 130*a* detects the tab paper St first, and then the second sensor 130*b* detects the tab paper St. Therefore, the time difference is generated between the timing when the first sensor 130*a* detects the tab paper St and the timing when the second sensor 130*b* detects the tab paper St. Therefore, depending on a magnitude of the time difference, it becomes possible to determine whether the sheet is the tab paper St.

However, in both cases where the plain paper Sp is conveyed with a skew posture and where the tab paper St is conveyed, a difference in the timing at which the first sensor 130*a* and the second sensor 130*b* detect the passage of the sheet is generated. In the present embodiment, depending on the set sheet mode, the conveyance state of the sheet S is determined with high accuracy.

In FIG. 4A to FIG. 4D, the sensor 130 includes the first sensor 130*a* and the second sensor 130*b* separated from each other, and the first sensor 130*a* and the second sensor 130*b* detect the end side portions of the sheet S, but the sensor 130 may not be separated. For example, the sensor 130 may extend from one end to the other end of the sheet conveyed in the conveyance direction.

In FIG. 4D, in the tab paper St, the tab is provided on the upstream side of the sheet to be conveyed, but the present embodiment is not limited thereto. The tab may be provided on the downstream side of the sheet.

Figure 5:
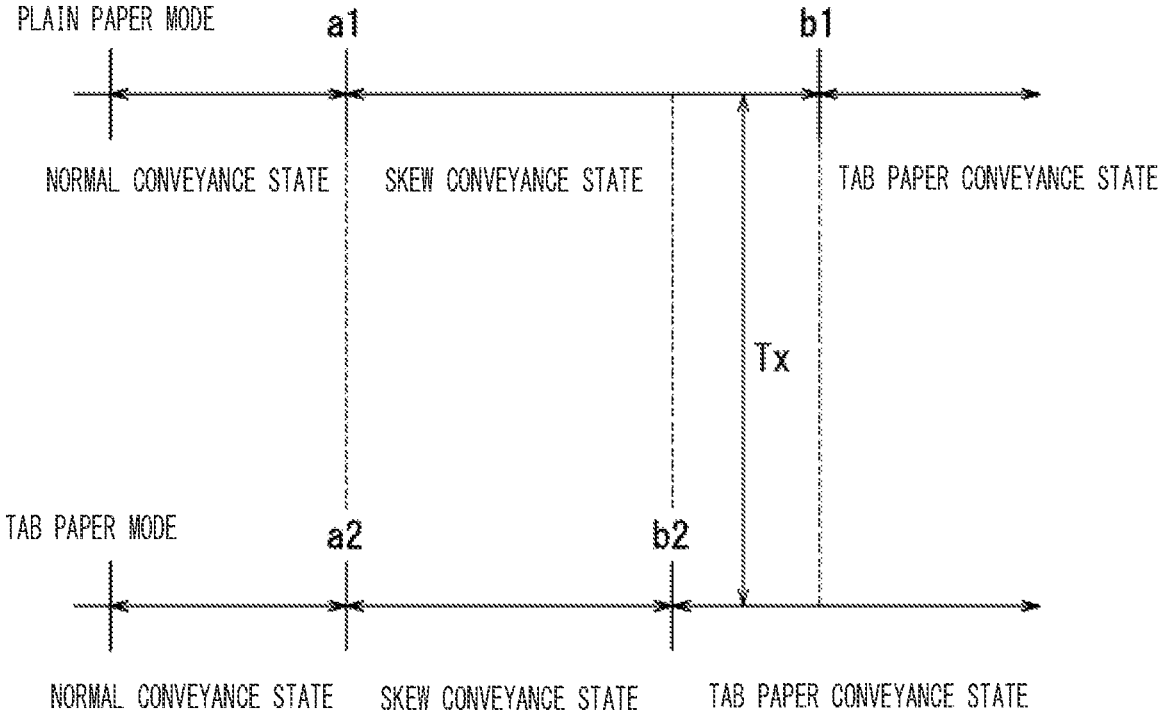
FIG. 5 is a diagram showing a relationship between a time difference of sheet passage and a conveyance state.

Next, with reference to FIG. 1 to FIG. 5, a relationship between a time difference of sheet passage and a conveyance state will be described. FIG. 5 is a diagram showing a relationship between a time difference of sheet passage and a conveyance state.

As shown in FIG. 5, in a case where the plain paper mode is set, when the time difference of sheet passage is within a range of zero or more and less than the first threshold a1, the conveyance state determination part 164 determines that it is a normal conveyance state where the plain paper is being conveyed normally. When the time difference of sheet passage is within a range of not less than the first threshold a1 and less than the second threshold b1, the conveyance state determination part 164 determines that it is the skew conveyance state where the plain paper is being conveyed with a skew posture. When the time difference of sheet passage is not less than the second threshold b1, the conveyance state determination part 164 determines that it is the tab paper conveyance state where the tab paper is being conveyed. When it is determined to be the tab paper conveyance state, the position of the tab may be specified and an image may be formed in the tab.

In FIG. 5, in a case of the tab paper mode, when the time difference of sheet passage is within a range of not less than zero and less than the first threshold a2, the conveyance state determination part 164 determines that it is the normal conveyance state where the plain paper is being conveyed normally. When the time difference of sheet passage is within a range of not less than the first threshold a2 and less than the second threshold b2, the conveyance state determination part 164 determines that it is the skew conveyance state where the plain paper is being conveyed with a skew posture. When the time difference of sheet passage is larger than the second threshold b2, the conveyance state determination part 164 determines that it is the tab paper conveyance state where the tab paper is being conveyed. When it is determined to be the tab paper conveyance state, the position of the tab may be specified and an image may be formed in the tab.

Here, the second threshold b2 in the tab paper mode is different from the second threshold b1 shown by the second threshold information in the plain paper mode. The second threshold b2 is smaller than the second threshold b1. Therefore, when the time difference of sheet passage is relatively small, even if it is determined to be the skew conveyance state in the plain paper mode, it is determined to the tab paper conveyance state in the tab paper mode.

For example, as shown in FIG. 5, when the time difference of sheet passage is Tx, it is determined to be the skew conveyance state in the plain paper mode, but it is determined to be the tab paper conveyance mode in the tab paper mode.

In the plain paper mode, the plain paper is set to be conveyed as the sheet, and there is a high possibility that the sheet to be conveyed actually is the plain paper. Therefore, even if it is determined to be the skew conveyance state of the plain paper except a case where the time difference is obviously large, the probability of erroneous determination is low. On the other hand, in the tab paper mode, the tab paper is set to be conveyed as the sheet, and there is a high possibility that the sheet to be conveyed actually is the tab paper. Therefore, when the time difference is not so large, even if it is determined to be not the skew conveyance state of the plain sheet but the tab paper conveyance state, the probability of erroneous determination is low. As described above, by appropriately changing the reference threshold based on the setting of the sheet mode, the conveyance state of the sheet can be determined with high accuracy according to the type of the set recording medium, and as a result, the sheet can be efficiently conveyed.

Although not described in detail in the description with reference to FIG. 5, the conveyance state may be determined by using the result of detecting not only the upstream side portion but also the downstream side portion of the sheet by the sensor 130. Further, in FIG. 5, when the tab paper mode is set, if the sensor 130 detects the upstream side end face of the sheet being conveyed to determine that it is in the normal conveyance state or the skew conveyance state, there is a possibility that the tab is provided in the downstream side end face of the sheet. Therefore, when the tab paper mode is set and it is determined to the state other than the tab paper conveyance state, it is preferable to detect with high accuracy whether the tab is provided in the downstream side end face of the sheet. Thus, an image can be accurately formed on the tab of the tab paper.

Figure 6:
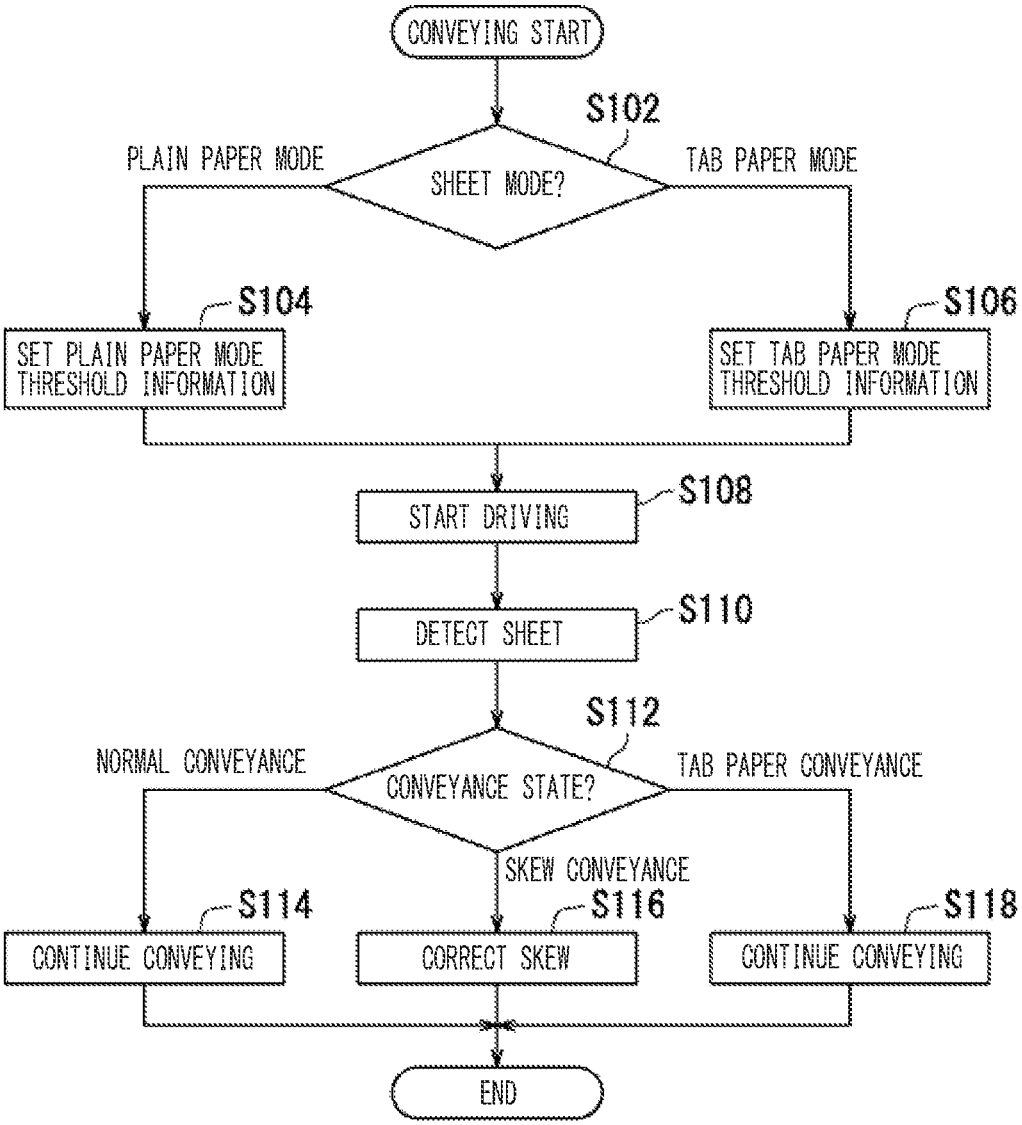
FIG. 6 is a flow diagram showing a sheet conveyance in the conveyance device according to the embodiment.

Next, with reference to FIG. 1 to FIG. 6, a flow for sheet conveying in the conveyance device 100 of the present embodiment will be described. FIG. 6 is a flowchart showing the sheet conveying in the conveyance device 100 of the present embodiment.

As shown in FIG. 6, in step S102, the conveyance state determination part 164 determines the sheet mode. The conveyance state determination part 164 determines whether the sheet mode is the plain paper mode or the tab paper mode. When the plain paper mode is set, the processing proceeds to step S104. When the tab paper mode is set, the processing proceeds to step S106.

In step S104, the threshold information of the plain paper mode is set. The threshold information of the plain paper mode is read from the storage part 170. Then, the processing proceeds to step S108.

In step S106, the threshold information of the tab paper mode is set. The threshold information of the tab paper mode is read from the storage part 170. Then, the processing proceeds to step S108.

In step S108, the drive control part 156 drives the conveyance roller 110 to rotate the conveyance roller 110, and starts the conveying of the sheet S. Then, the processing proceeds to step S110.

In step S110, the sensor 130 detects the sheet S. For example, the first sensor 130*a* and the second sensor 130*b* detect the timing at which the sheet S passes through the detection regions, and the time difference of sheet passage is obtained by the first sensor 130*a* and the second sensor 130*b*. The processing proceeds to step S112.

In step S112, the conveyance state determination part 164 determines the conveyance state of the sheet S based on the detection result of the sensor 130 and the threshold information. In detail, in a case of the plain paper mode, the conveyance state determination part 164 determines the conveyance state of the sheet S based on the threshold information of the plain paper mode with respect to the time difference obtained by the sensor 130. In a case of the tab paper mode, the conveyance state determination part 164 determines the conveyance state of the sheet S based on the threshold information of the tab paper mode with respect to the time difference obtained by the sensor 130.

When the conveyance state determination part 164 determines that the conveyance state of the sheet S is the normal conveyance state, the processing proceeds to step S114. When the conveyance state determination part 164 determines that the conveyance state of the sheet S is the skew conveyance state, the processing proceeds to step S116. When the conveyance state determination part 164 determines that the conveyance state of the sheet S is the tab paper conveyance state, the processing proceeds to step S118.

In step S114, the drive control part 156 continues the rotating of the conveyance roller 110 to convey the sheet S without stopping the conveying of the sheet S by the registration roller 120. When the sheet S is conveyed to the end point, the processing is completed.

In step S116, the drive control part 156 rotates the conveyance roller 110 to convey the sheet S to the registration roller 120, and then stops the conveying of the sheet S by the registration roller 120. Then, the skew of the sheet S is corrected. Thereafter, the drive control part 156 rotates the registration roller 120 and continues the rotating of the conveyance roller 110, and conveys the sheet S to the end point. Then, the processing is completed.

In step S118, the drive control part 156 continues the rotating of the conveyance roller 110 to convey the sheet S without stopping the conveying of the sheet S by the registration roller 120. When the sheet is conveyed to the end point, the processing is completed.

According to the present embodiment, depending on the set sheet mode, a determination reference for determining the conveyance state of the sheet is varied. Further, the conveyance state of the sheet S is determined, and the conveying of the sheet S is controlled depending on the determined conveyance state. Therefore, it becomes possible to convey the sheet S efficiently depending to the type of the recording medium to be set.

In the description with reference to FIG. 3A to FIG. 6, the conveyance state determination part 164 determines the skew state of the plain paper Sp, but the present embodiment is not limited thereto. The conveyance state determination part 164 may determine the skew state of the tab paper St.

Figures 7A, 7B:
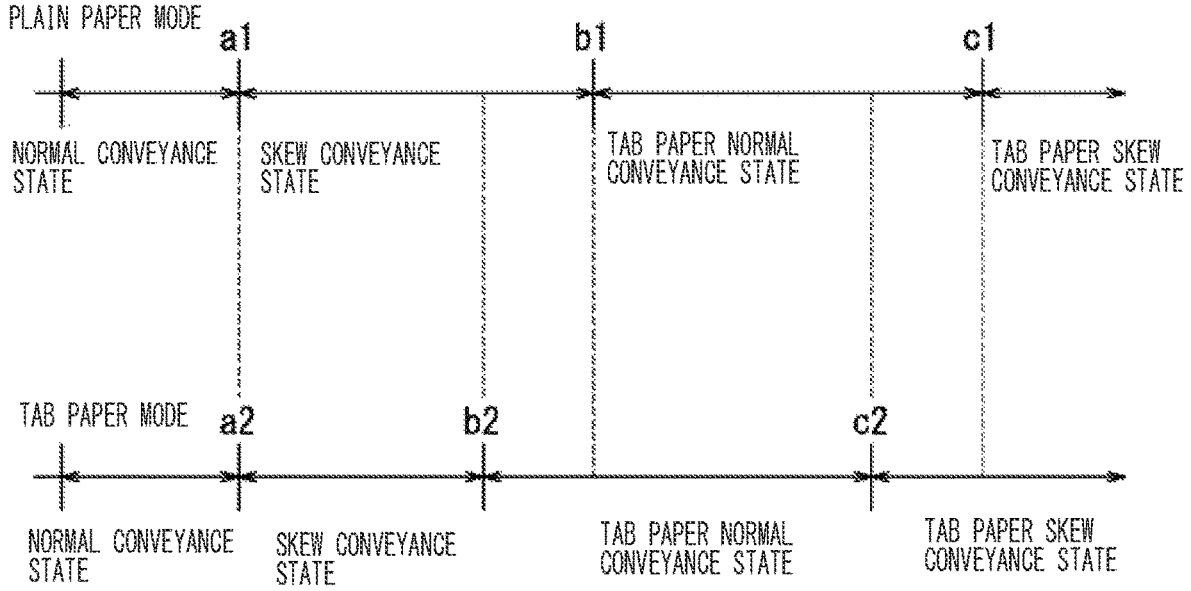
FIG. 7A is a table showing threshold information corresponding to the sheet mode in the conveyance device according to the embodiment.
FIG. 7B is a diagram showing a relationship between a time difference of sheet conveyance and a conveyance state.

Next, with reference to FIG. 7A and FIG. 7B, the conveying of the sheet in the conveyance device 100 of the present embodiment will be described. FIG. 7A is a table showing the threshold information stored in the storage part 170. As shown in FIG. 7A, the threshold information shows a third threshold in addition to the first threshold and the second threshold. The third threshold information shows a threshold using for determining the normal conveyance state of the tab paper and the skew conveyance state of the tab paper. The table shown in FIG. 7A is the same as the table described above with reference to FIG. 3B except that it further contains the third threshold information, and the overlapping description is omitted for convenience of explanation.

The storage part 170 stores the third threshold information in addition to the first threshold information and the second threshold information. The third threshold information shows the third threshold for determining whether the tab paper is conveyed normally or with a skew posture.

In the plain paper mode, the third threshold shows a third threshold c1. Here, the third threshold c1 is larger than the second threshold b1 (b1<c1). When the time difference obtained by the sensor 130 is not less than the second threshold b1 and less than the third threshold c1, it is determined that the tab paper is conveyed normally. When the time difference is larger than the third threshold c1, it is determined that the tab paper is conveyed with a skew state.

In the tab paper mode, the third threshold information shows a third threshold c2. Here, the third threshold c2 is larger than the second threshold b2 (b2<c2). When the time difference obtained by the sensor 130 is not less than the second threshold b2 and less than the third threshold c2, it is determined that the tab paper is conveyed normally. When the time difference is larger than the third threshold c2, it is determined that the tab paper is conveyed with a skew state.

For example, the third threshold c2 in the tab paper mode may be smaller than the third threshold c1 in the plain paper mode. As an example, the difference between the second threshold b2 and the third threshold c2 in the tab paper mode may be equal to the difference between the second threshold b1 and the third threshold c1 in the plain paper mode.

Next, with reference to FIG. 7B, a relationship between a time difference of sheet passage and a conveyance state will be described. FIG. 7B is a diagram showing a relationship between a time difference of sheet passage and a conveyance state. FIG. 7B is the same as the drawing described above with reference to FIG. 5 except that the third threshold showing the reference of the tab paper normal conveyance state and the tab paper skew conveyance state is further added, and the overlapping description is omitted for convenience of the description.

As shown in FIG. 7B, in a case the plain paper mode, when the time difference of sheet passage is not less than the second threshold b1 and less than the third threshold c1, the conveyance state determination part 164 determines that it is the tab paper normal conveyance state. Further, when the time difference of sheet passage is larger than the third threshold c1, the conveyance state determination part 164 determines that it is the tab paper skew conveyance state.

On the other hand, in a case of the tab paper mode, when the time difference of sheet passage is not less than the second threshold b2 and less than the third threshold c2, the conveyance state determination part 164 determines that it is the tab paper normal conveyance state. Further, when the time difference of sheet passage is larger than the third threshold c2, the conveyance state determination part 164 determines that it is the tab paper skew conveyance state.

In the present embodiment, it becomes possible to determine whether the tab paper is conveyed normally or with a skew posture, depending on the time difference obtained by the sensor 130. When the tab paper is conveyed with a skew posture, the conveyance device 100 preferably corrects the skew of the sheet by the conveyance roller 110 without driving the registration roller 120.

In the description with reference to FIG. 7A and FIG. 7B, the third threshold c2 in the tab paper mode is different from the third threshold c1 in the plain paper mode, but the present embodiment is not limited thereto. The third threshold c2 in the tab paper mode may be equal to the third threshold c1 in the plain paper mode.

Figure 8:
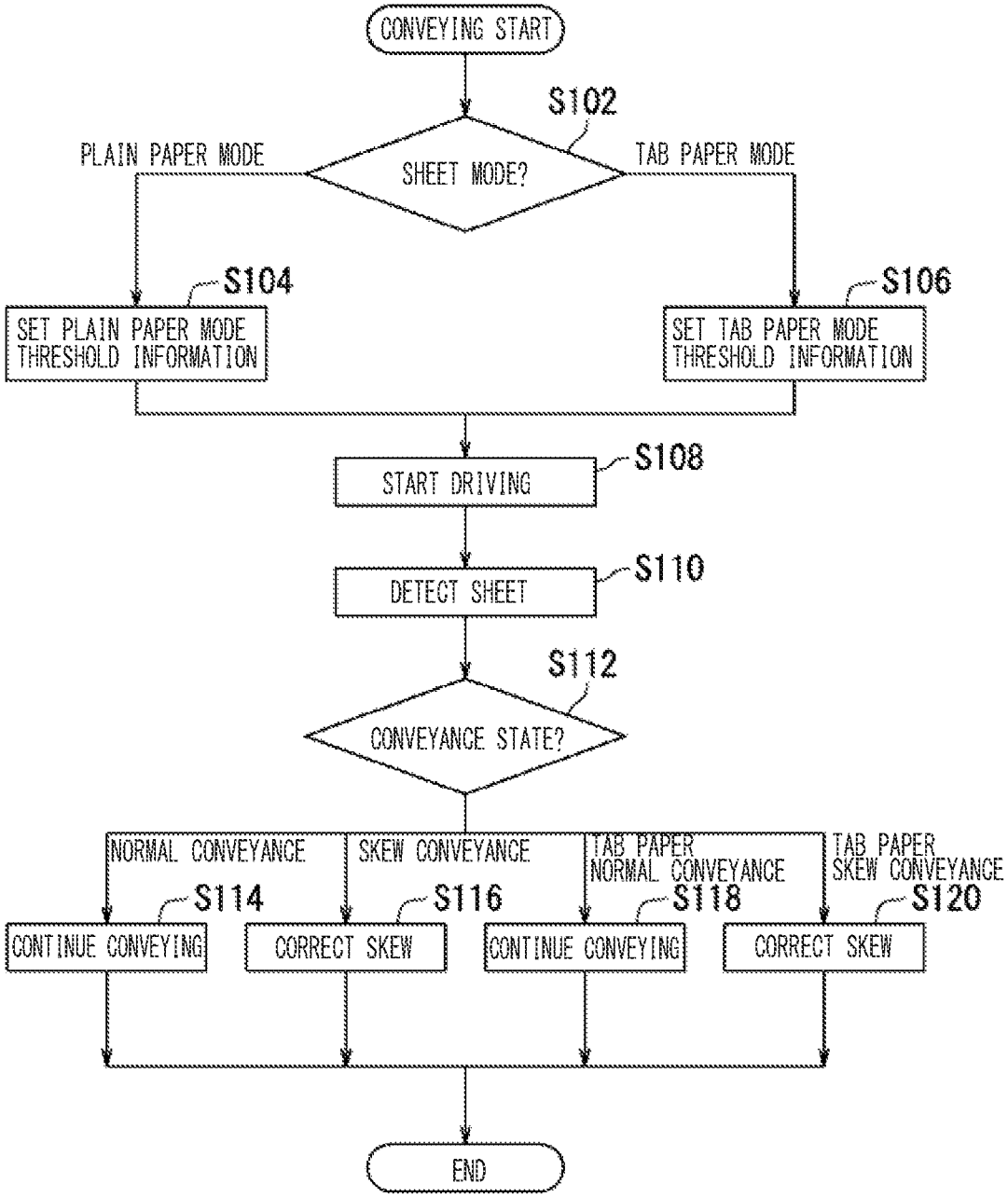
FIG. 8 is a flow diagram showing a sheet conveyance in the conveyance device according to the embodiment.

Next, with reference to FIG. 8, a flow which enables the determination whether the tab paper is conveyed normally or with a skew posture, in the sheet conveying in the conveyance device 100 of the present embodiment. FIG. 8 is a flowchart showing the sheet conveying in the conveyance device 100 of the present embodiment. The flowchart shown in FIG. 8 contains the same steps as the flowchart described above with reference to FIG. 6 except that step S120 is added, and the overlapping description is omitted for convenience of explanation.

As shown in FIG. 8, in step S102, the conveyance state determination part 164 determines the sheet mode. The conveyance state determination part 164 determines whether the sheet mode is the plain paper mode or the tab paper mode. When the plain paper mode is set, the processing proceeds to step S104. When the tab paper mode is set, the processing proceeds to step S106.

In step S104, the threshold information of the plain paper mode is set. The threshold information of the plain paper mode is read from the storage part 170. Here, the threshold information of the plain paper mode (that is, the information showing the first threshold a1, the second threshold b1 and the third threshold c1) from the storage part 170 is read. Thereafter, the processing proceeds to step S108.

In step S106, the threshold information of the tab paper mode is set. The threshold information of the tab paper mode is read from the storage part 170. Here, the threshold information of the tab paper mode (that is, the information showing the thirst threshold a2, the second threshold b2 and the third threshold c2) from the storage part 170 is read. Thereafter, the processing proceeds to step S108.

In step S108, the drive control part 156 drives the conveyance roller 110 to rotate the conveyance roller 110 and starts the conveying of the sheet S. Thereafter, the processing proceeds to step S110.

In step S110, the sensor 130 detects the sheet S. For example, the first sensor 130*a* and the second sensor 130*b* detect the timing at which the sheet S passes through the detection regions, and the time difference of the passage of the sheet S is obtained by the first sensor 130*a* and the second sensor 130*b*. The processing proceeds to step S112.

In step S112, the conveyance state determination part 164 determines the conveyance state of the sheet based on the detection result of the sheet. When the conveyance state determination part 164 determines that the plain paper is conveyed normally, the processing proceeds to step S114. When the conveyance state determination part 164 determines that the plain paper is conveyed with a skew posture, the processing proceeds to step S116. When the conveyance state determination part 164 determines that the tab paper is conveyed normally, the processing proceeds to step S118. When the conveyance state determination part 164 determines that the tab paper is conveyed with a skew posture, the processing proceeds to step S120.

In step S114, the drive control part 156 continues the rotating of the conveyance roller 110 to convey the sheet S without stopping the conveying of the sheet S by the registration roller 120. When the sheet S is conveyed to the end point, the processing is completed.

In step S116, the drive control part 156 rotates the conveyance roller 110 to convey the sheet S to the registration roller 120, and then stops the conveying of the sheet S by the registration roller 120. Thus, the skew of the sheet S is corrected. Thereafter, the drive control part 156 rotates the registration roller 120 and continues the rotating the conveyance roller 110 to convey the sheet S to the end point. Then, the processing is completed.

In step S118, the drive control part 156 continues the rotating of the conveyance roller 110 to convey the sheet S without stopping the conveying of the sheet by the registration roller 120. When the sheet S is conveyed to the end point, the processing is completed.

In step S120, the drive control part 166 controls the conveyance speed or the inclination of the conveyance roller 110 to correct the skew of the sheet. When the sheet S is conveyed to the end point, the processing is completed.

As described above, according to the present embodiment, based on the detection result of the sensor 130, it becomes possible to determine the skew of the tab paper. Therefore, even if the tab paper is conveyed with a skew posture, it becomes possible to correct the skew of the tab paper.

In the description described above, the sheet mode is set to either one of the two modes containing the plain paper mode and the tab paper mode, but the present embodiment is not limited thereto. The sheet mode may be set to either one of the three or more modes.

Figures 9A, 9B:
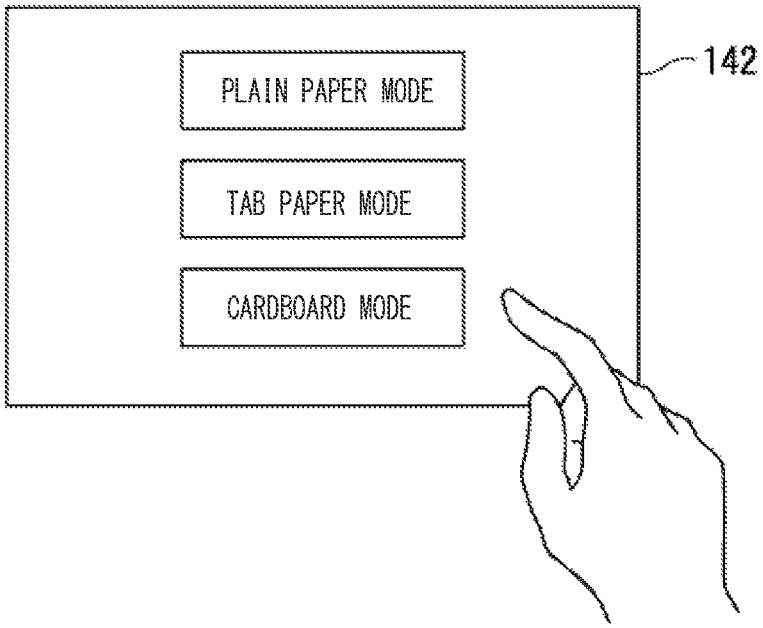
FIG. 9A is a schematic view showing a setting of the sheet mode in the conveyance device according to the embodiment.
FIG. 9B is a table showing the threshold information corresponding to the sheet mode in the conveyance device according to the embodiment.

Next, with reference to FIG. 9A and FIG. 9B, the setting of the sheet mode and the threshold corresponding to the set sheet mode in the conveyance device 100 of the present embodiment will be described. FIG. 9A is a diagram schematically showing the setting of the sheet mode in the conveyance device 100 of the present embodiment. FIG. 9B is a diagram showing the threshold information corresponding to the sheet mode in the conveyance device 100 of the present embodiment. FIG. 9A and FIG. 9B are the same as the description described above with reference to FIG. 3A and FIG. 3B except that a cardboard mode is added, and the overlapping description is omitted for convenience of the explanation.

As shown in FIG. 9A, the conveyance device 100 can set the sheet mode in the plain paper mode, in the tab paper mode or in the cardboard mode. As shown in FIG. 9A, in a case where the display part 142 and the input part 144 are the touch panel, when an icon for the plain paper mode is touched, the plain paper mode is set. When an icon for the tab paper mode is touched, the tab paper mode is set. When an icon for the cardboard mode is touched, the cardboard mode is set.

The plain paper mode is a mode suitable for the conveying of the plain paper. However, even if the plain paper mode is set, the sheet other than the plain paper may be conveyed. For example, even if the plain paper mode is set, the tab paper or the cardboard may be conveyed.

The tab paper mode is a mode suitable for the conveying of the tab paper. However, even if the tab paper mode is set, the sheet other than the tab paper may be conveyed. For example, even if the tab paper mode is set, the plain paper or the cardboard may be conveyed.

The cardboard mode is a mode suitable for the conveying of the cardboard. However, even if the cardboard mode is set, the sheet other than the cardboard may be conveyed. For example, even if the cardboard is set, the plain paper or the tab paper may be conveyed.

The determination whether the sheet is conveyed normally or with a skew posture or the sheet is the tab paper is performed using the threshold information. The threshold information used in the plain paper mode, the tab paper mode and the cardboard mode are not equal.

As shown in FIG. 9B, the storage part 170 stores the first threshold information and the second threshold information. The first threshold information is a reference when it is determined whether the sheet is conveyed normally or with a skew posture. The second threshold information is a reference when it is determined whether the sheet is the tab paper.

In the cardboard mode, the first threshold information shows a first threshold a3. The first threshold a3 is used for determining whether the sheet is conveyed normally or with a skew posture. When the time difference is less than the first threshold a3, it is determined that the sheet S is conveyed normally (is not conveyed with a skew posture).

In the cardboard mode, the second threshold information shows a second threshold b3. Here, the second threshold b3 is larger than the first threshold a3 (a3<b3). The second threshold b3 is used for determining whether the sheet is conveyed with a skew posture or the sheet is the tab paper. When the time difference is larger than the second threshold b3, it is determined that the sheet S is the tab paper. When the time difference is not less than the first threshold a3 and less than the second threshold b3, it is determined that the sheet S is conveyed with a skew posture.

Here, the first threshold a3 in the cardboard mode is equal to the first threshold a1 in the plain paper mode and/or the first threshold a2 in the tab paper mode.

The second threshold b3 in the cardboard mode is smaller than the second threshold b1 in the plain paper mode and larger than the second threshold b2 in the tab paper mode. Thereby, in the cardboard mode, even if the time difference is relatively small compared with in the plain paper mode, it is determined that the tab paper is conveyed. In the cardboard mode, even if the time difference is relatively small compared with the tab paper mode, it is determined to be not the tab paper conveyance but the skew conveyance.

Figure 10:
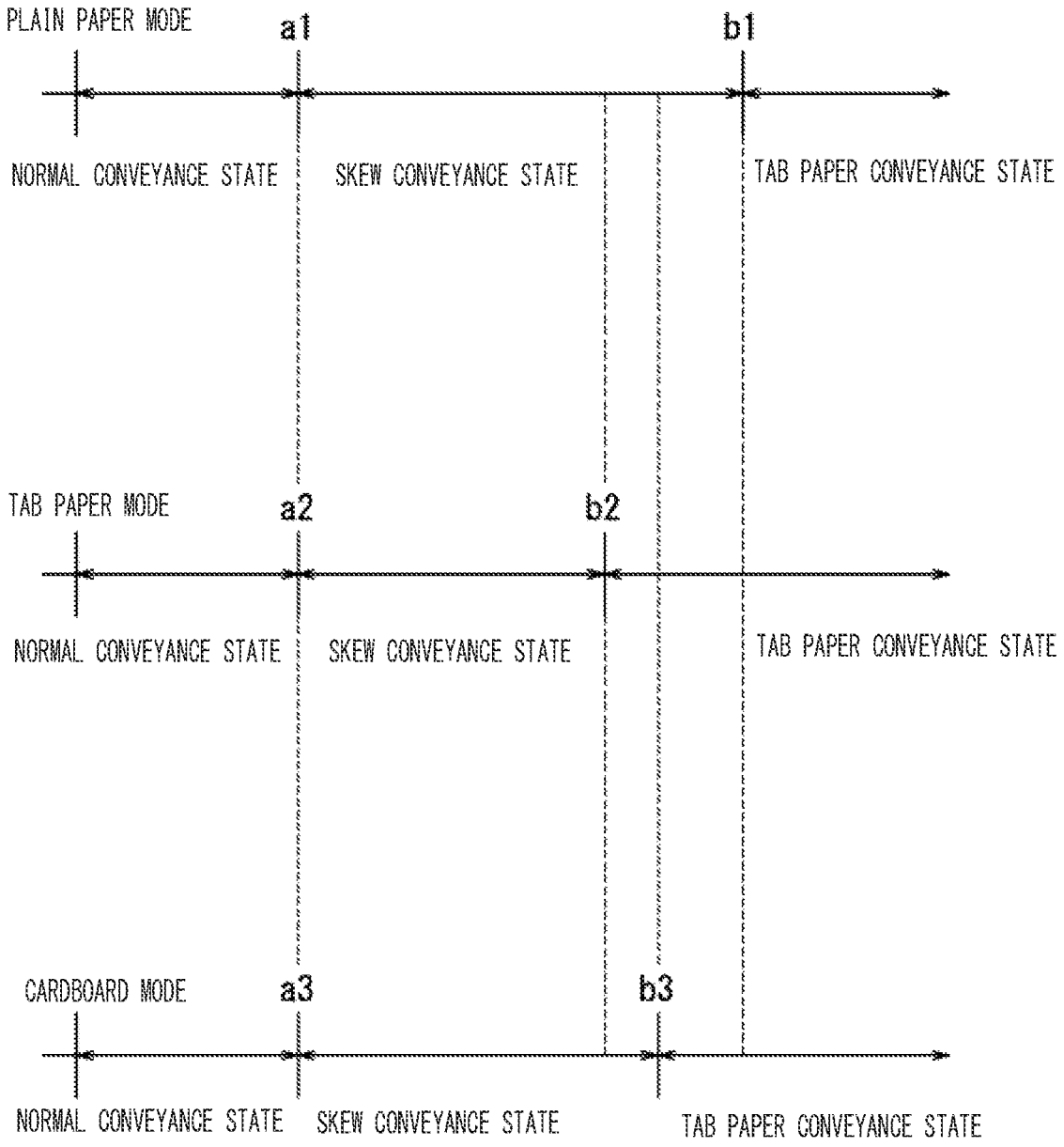
FIG. 10 is a diagram showing a relationship between a time difference of sheet conveyance and a conveyance state.

Next, with reference to FIG. 10, a relationship between a time difference of sheet passage and a conveyance state will be described. FIG. 10 is a diagram showing a relationship between a time difference of sheet passage and a conveyance state. FIG. 10 is the same as the description described above with reference to FIG. 5 except that the cardboard mode is added, and the overlapping description is omitted for convenience of explanation.

As shown in FIG. 10, in a case of the cardboard mode, when the time difference of sheet passage is within a range of not less than zero and less than the first threshold a3, the conveyance state determination part 164 determines that it is the normal conveyance state. When the time difference of sheet passage is within a range of not less than the first threshold a3 and less than the second threshold b3, the conveyance state determination part 164 determines that it is the skew conveyance state. When the time difference of sheet passage is larger than the second threshold b3, the conveyance state determination part 164 determines that it is the tab paper conveyance state.

Here, the second threshold b3 used in the cardboard mode is different from the second threshold b1 used in the plain paper mode and the second threshold b2 used in the tab paper mode. A value of the second threshold b3 is smaller than the second threshold b1 and larger than the second threshold b2. Then, in a case where the time difference of sheet passage shows a certain value, even when it is determined to be the skew conveyance state in the plain paper mode, it may be determined to be the tab paper conveyance state in the cardboard mode. Further, in a case where the time difference of sheet passage shows another value, even when it is determined to be the skew conveyance state in the cardboard mode, it may be determined to be the tab paper conveyance state in the tab paper mode.

As described above, it becomes possible to determine the sheet conveyance state with high accuracy depending on the setting state of the sheet mode. Therefore, it becomes possible to convey the sheet efficiently.

Figure 11:
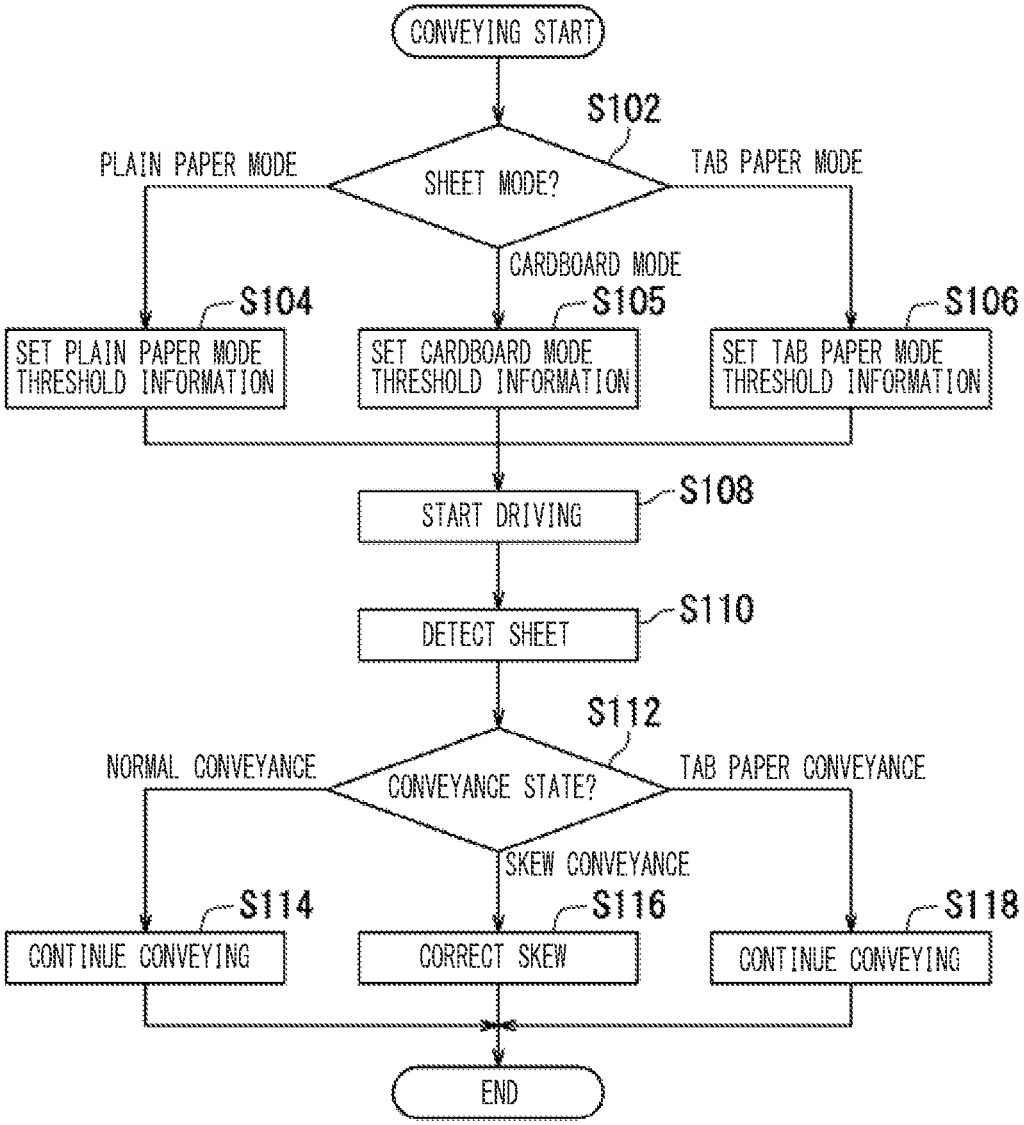
FIG. 11 is a flow diagram showing a sheet conveyance in the conveyance device according to the embodiment.

Next, with reference to FIG. 11, a flow for conveying the sheet in the conveyance device 100 of the present embodiment will be described. FIG. 11 is a flowchart showing the sheet conveyance in the conveyance device 100 of the present embodiment. The flowchart shown in FIG. 11 is the same as the flowchart described above with reference to FIG. 6 except the cardboard mode is added, and the overlapping description is omitted for convenience of explanation.

As shown in FIG. 11, in step S102, the conveyance state determination part 164 determines the sheet mode. The conveyance state determination part 164 determines whether the sheet mode is the plain paper mode, the tab paper mode or the cardboard mode. When it is set to the plain paper mode, the processing proceeds to step S104. When it is set to the cardboard mode, the processing proceeds to step S105. When it is set to the tab paper mode, the processing proceeds to step S106.

In step S104, the threshold information of the plain paper mode is set. The threshold information of the plain paper mode is read from the storage part 170. Thereafter, the processing proceeds to step S108.

In step S105, the threshold information of the cardboard mode is set. The threshold information of the cardboard mode is read from the storage part 170. Thereafter, the processing proceeds to step S108.

In step S104, the threshold information of the tab paper mode is set. The threshold information of the tab paper mode is read from the storage part 170. Thereafter, the processing proceeds to step S108.

In step S108, the drive control part 156 drives the conveyance roller 110 to rotate the conveyance roller 110 to start the conveying of the sheet S. Thereafter, the processing proceeds to step S110.

In step S110, the sensor 130 detects the sheet S. For example, the first sensor 130*a* and the second sensor 130*b* detect the timing at which the sheet S passes through the detection regions, and the time difference of passage of the sheet S is obtained by the first sensor 130*a* and the second sensor 130*b*. The processing proceeds to step S112.

In step S112, the conveyance state determination part 164 determines the conveyance state of the sheet based on the detection result of the sheet sensor 130 and the threshold information. When the cardboard mode is set, the conveyance state determination part 164 determines the conveyance state of the sheet S based on the threshold information of the cardboard mode to the time difference obtained by the sensor 130.

When the conveyance state determination part 164 determines that the conveyance state of the sheet S is the normal conveyance state, the processing proceeds to step S114. When the conveyance state determination part 164 determines that the conveyance state of the sheet S is the skew conveyance state, the processing proceeds to step S116. When the conveyance state determination part 164 determines that the conveyance state of the sheet S is the tab paper conveyance state, the processing proceeds to step S118.

In step S114, the drive control part 156 continues the rotating of the conveyance roller 110 to convey the sheet S without stopping the conveying of the sheet S by the registration roller 120. When the sheet S is conveyed to the end point, the processing is completed.

In step S116, the drive control part 156 rotates the conveyance roller 110 to convey the sheet S to the registration roller 120, and then stops the conveying of the sheet S by the registration roller 120. Thus, the skew of the sheet S is corrected. Thereafter, the drive control part 156 rotates the registration roller 120 and continues the rotating the conveyance roller 110 to convey the sheet S to the end point. When the sheet is conveyed to the end point, the processing is completed.

In step S118, the drive control part 156 continues the rotating of the conveyance roller 110 to convey the sheet S without stopping the conveying of the sheet by the registration roller 120. When the sheet S is conveyed to the end point, the processing is completed.

According to the present embodiment, even if the cardboard mode is set, it becomes possible to determine the skew conveyance state and the tab paper conveyance state with high accuracy. Therefore, it becomes possible to convey the sheet S efficiently.

The image forming apparatus 200 shown in FIG. is the electrophotographic type, but the present disclosure is not limited thereto. The image forming apparatus 200 may be another type. For example, the image forming apparatus 200 may be an inkjet type.

In FIG. 1, the conveyance device 100 is used for conveying the sheet S in the image forming part 220 of the image forming apparatus 200, but the present disclosure is not limited thereto. The conveyance device 100 may be used for conveying a document to an image reading device.

Figure 12:
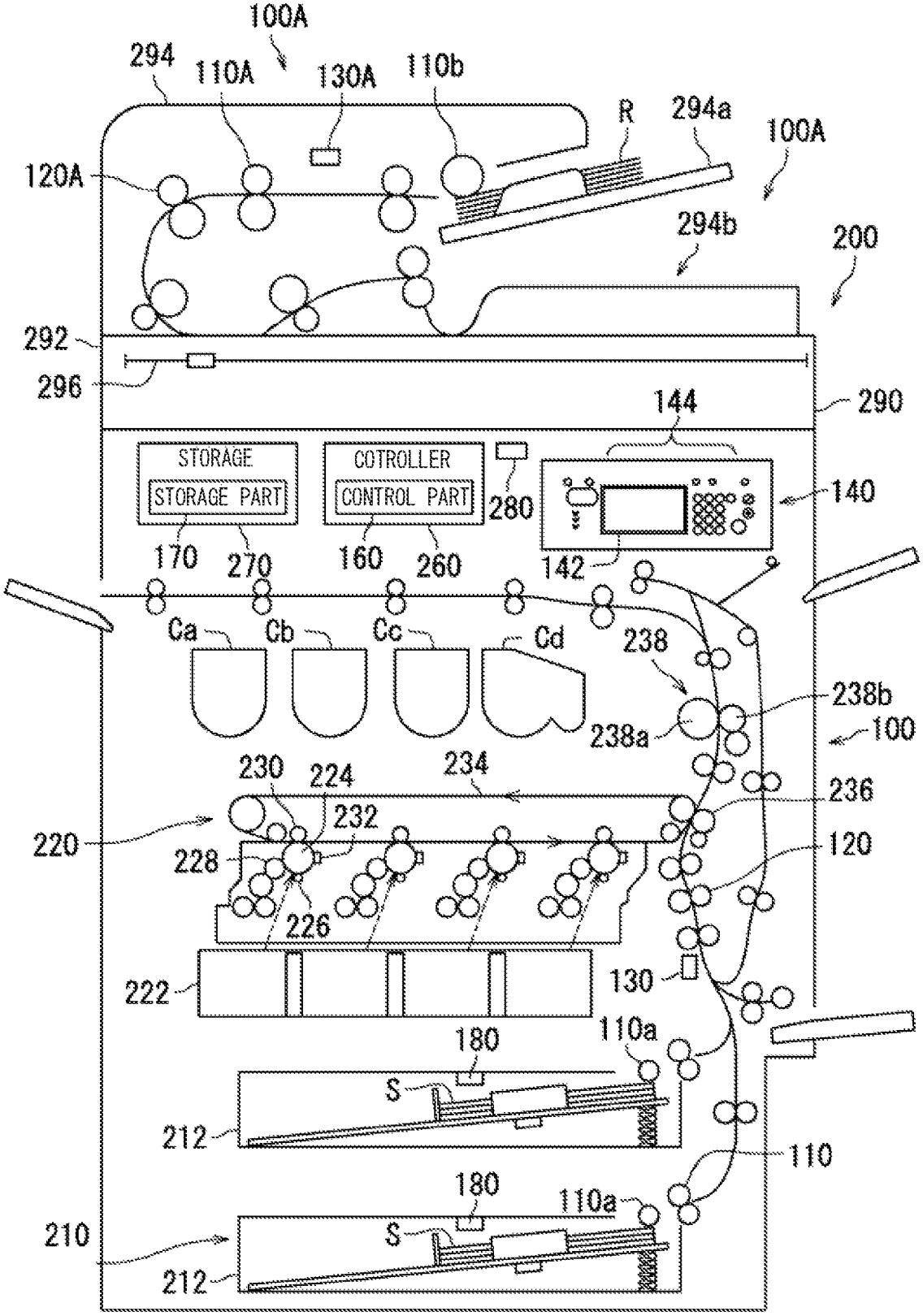
FIG. 12 is a schematic view showing an image forming apparatus according to the embodiment.

Next, with reference to FIG. 12, the image forming apparatus 200 of the present embodiment will be described. FIG. 12 is a diagram schematically showing the image forming apparatus 200 of the present embodiment. The image forming apparatus 200 shown in FIG. 12 has the same configuration as that of the image forming apparatus 200 described above with reference to FIG. 1 except that an image reading part 290 is further provided, and the overlapping description is omitted for convenience of explanation.

As shown in FIG. 12, the image forming apparatus 200 includes the image reading part 290 in addition to the sheet storage part 210, the image forming part 220, the controller 260, the storage 270 and the communication part 280. The image reading part 290 reads an image. For example, the image reading part 290 reads an image of a document R. The document R contains a plain paper, a recycled paper, a thin paper, a cardboard or a coated paper, for example. The document R is an example of a recording medium.

The image reading part 290 includes a conveyance device 100A, a document table 292, a platen cover 294, and a reading part 296. The document table 292 has an approximately parallelepiped shape. The document is placed on the document table 292.

The reading part 296 reads the document and generates image data. The reading part 296 reads the document disposed in the document table 292, and generates the image data. The reading part 296 is disposed in the document table 292.

The platen cover 294 has an approximately thin parallelepiped shape. The platen cover 294 is disposed above the document table 292. The platen cover 294 is openable and closable to the document table 292. The platen cover 294 includes a table 294*a* on which the document R is placed and a discharge part 294*b*.

The conveyance device 100A is set in the platen cover 294. The conveyance device 100A conveys the document R placed on the table 294*a* to the discharge part 294*b*. The conveyance device 100A functions as an automatic document feeder (ADF).

The conveyance device 100A includes a conveyance roller 110A, a registration roller 120A and a sensor 130A. The conveyance roller 110A, the registration roller 120A and the sensor 130A each has the same configuration as the conveyance roller 110, the registration roller 120 and the sensor 130 of the conveyance device 100. The conveyance roller 110A includes a sheet feeding roller 110*b*.

The conveyance roller 110A, the registration roller 120A and the sensor 130A are disposed inside the platen cover 294. The conveyance roller 110A forms a conveyance path for the document R. On a middle of the conveyance path, the document R faces the reading part 296. The reading part 296 reads the image of the document R conveyed along the conveyance path, and generates the image data representing the read image.

As described above, in the image forming apparatus 200 of the present embodiment, the conveyance device 100 conveys the sheet S to the image forming part 220. In the image forming apparatus 200 of the present disclosure, the conveyance device 100A is used for conveying the document R whose image is be read to the image reading part 290.

Next, with reference to FIG. 13, the image forming apparatus 200 of the present embodiment will be described.

Figure 13:
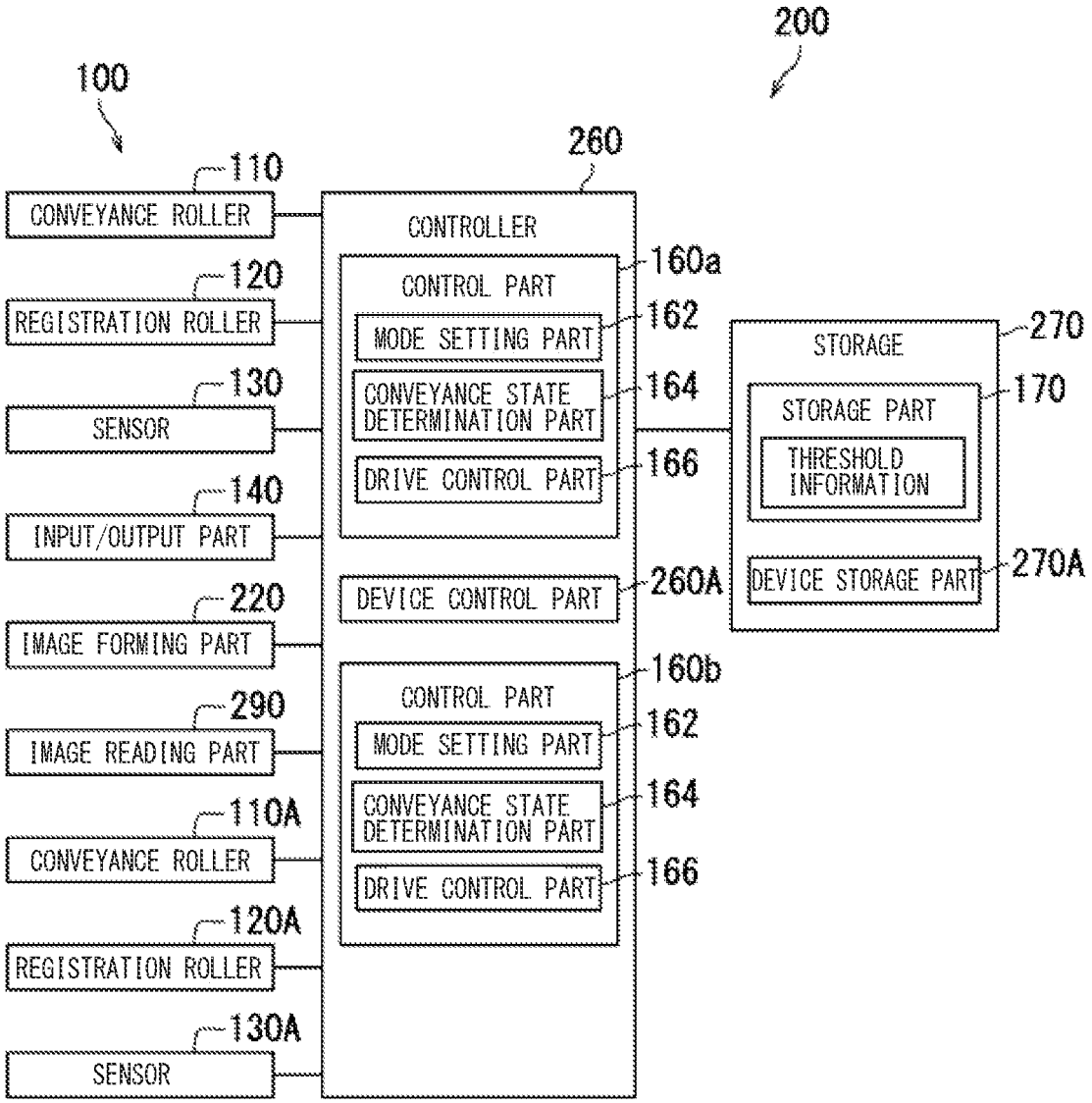
FIG. 13 is a block diagram showing the image forming apparatus according to the embodiment.

FIG. 13 is a block diagram showing the image forming apparatus 200 of the present embodiment.

As shown in FIG. 13, the controller 260 includes a first control part 160*a*, a second control part 160*b* and a device control part 260A. The first control part 160*a* controls the operation of the conveyance device 100 in order to convey the sheet S to the image forming part 220. The second control part 160*b* controls the operation of the conveyance device 100 in order to the sheet S to the image reading part 290. Each of the first control part 160*a* and the second control part 160*b* includes the mode setting part 162, the conveyance state determination part 164 and the drive control part 166. The mode setting part 162, the conveyance state determination part 164 and the drive control part 166 are operated in the same manner as those of the above-described manner, and the description is omitted. In each of the first control part 160*a* and the second control part 160*b*, the mode setting part 162, the conveyance state determination part 164 and the drive control part 166 are embodied by executing the computer program stored in the storage part 170 by the control part 160.

In the description with reference to FIG. 12 and FIG. 13, in the image forming apparatus 200, the conveyance device 100 of the present embodiment conveys the sheet S to the image forming part 220 and the conveyance device 100A of the present embodiment conveys the sheet S to the image reading part 290, but the preset embodiment is not limited thereto. The conveyance device of the present embodiment may be used to convey the document R to the image reading part. That is, the conveyance device of the present embodiment may be used for an image reading device.

Embodiments of the present disclosure have been described above with reference to the drawings. However, the present disclosure is not limited to the embodiments described above, and it is possible to carry out the present disclosure in various embodiments without departing from the gist thereof. Various disclosures can be formed by appropriately combining a plurality of components disclosed in the above embodiments. For example, some of the components may be removed from all of the components shown in the embodiments. In addition, components across different embodiments may be combined as appropriate. In order to facilitate understanding, each component is schematically shown, and the thickness, length, number, gap, and the others of each illustrated component may be different from the actual one for the convenience of drawing. The materials, shapes, dimensions, and the others of the components shown in the above embodiments are not particularly limited, and various modifications can be made without substantially departing from the effects of the present disclosure.

The present disclosure is suitably used for a conveyance device and an image forming apparatus.

The invention claimed is:

1. A conveyance device comprising:

a conveyance roller which conveys a recording medium;

a registration roller which stops a conveying of the recording medium conveyed by the conveyance roller and then starts the conveying of the recording medium again;

a sensor which detects the recording medium conveyed by the conveyance roller;

a mode setting part which sets a mode corresponding to a type of the recording medium;

a storage which stores threshold information corresponding to the mode set in the mode setting part;

a conveyance state determination part which determines a conveyance state of the recording medium based on a detection result of the sensor and the threshold information; and a drive control part which controls a driving of the conveyance roller and the registration roller based on a determination result of the conveyance state determination part, wherein the mode setting part sets the mode to either a plain paper mode or a tab paper mode, the storage stores plain paper mode threshold information showing a threshold used in the plain paper mode and tab paper mode threshold information showing a threshold used in the tab paper mode, the conveyance state determination part determines, when the plain paper mode is set, whether the conveyance state of the recording medium is a skew conveyance state or a tab paper conveyance state, based on the detection result of the sensor and the plain paper mode threshold information, and the conveyance state determination part determines, when the tab paper mode is set, whether the conveyance state of the recording medium is the skew conveyance state or the tab paper conveyance state, based on the detection result of the sensor and the tab paper mode threshold information.

2. The conveyance device according to claim 1, wherein the sensor detects passage of different regions of an end face of the recording medium conveyed by the conveyance roller and obtains a time difference of the passage of the different regions, the conveyance state determination part, when the plain paper mode is set, compares the time difference obtained by the sensor with the threshold of the plain paper mode and determines whether the conveyance state of the recording medium is the skew conveyance state or the tab paper conveyance state, and the conveyance state determination part, when the tab paper mode is set, compares the time difference obtained by the sensor with the threshold of the tab paper mode and determines whether the conveyance state of the recording medium is the skew conveyance state or the tab paper conveyance state.

3. The conveyance device according to claim 2, wherein the threshold of the tab paper mode is smaller than the threshold of the plain paper mode.

4. The conveyance device according to claim 1, wherein the mode setting part sets the mode to the plain paper mode, the tab paper mode or a cardboard mode, the storage further stores cardboard threshold mode information showing a threshold used in the cardboard mode, and the conveyance state determination part, when the cardboard mode is set, determines whether the conveyance state of the recording medium is the skew conveyance state or the tab paper conveyance state, based on the detection result of the sensor and the cardboard mode threshold information.

5. The conveyance device according to claim 4, wherein the threshold of the cardboard mode is smaller than the threshold of the plain paper mode, and the threshold of the cardboard mode is larger than the threshold of the tab paper mode.

6. The conveyance device according to claim 1, wherein when the conveyance state determination part determines the conveyance state of the recording medium to the skew conveyance state, the drive control part drives the registration roller so as to stop the conveying of the recording medium and then drives the conveyance roller and the registration roller to start the conveying of the recording medium.

7. The conveyance device according to claim 1, wherein when the conveyance state determination part determines the conveyance state of the recording medium to a tab paper skew conveyance state, the drive control part drives the conveyance roller so as to correct the skew of the recording medium without stopping the conveying of the recording medium by the registration roller.

8. An image forming apparatus comprising:

the conveyance device according to claim 1, and an image forming part which forms an image on the recording medium conveyed by the conveyance device.

* * * * *